US006459865B2

(12) United States Patent
Kusayanagi

(10) Patent No.: US 6,459,865 B2
(45) Date of Patent: Oct. 1, 2002

(54) LIQUID-DEVELOPING ELECTRO-PHOTOGRAPHIC PRINTER PHOTOSENSITIVE BODY CLEANING METHOD

(75) Inventor: Toshiya Kusayanagi, Niigata (JP)

(73) Assignee: Fuji Xerox Co., Ltd. (JP)

( * ) Notice: Subject to any disclaimer, the term of this patent is extended or adjusted under 35 U.S.C. 154(b) by 43 days.

(21) Appl. No.: 09/778,577

(22) Filed: Feb. 7, 2001

(30) Foreign Application Priority Data

Feb. 16, 2000 (JP) ..... 2000-037909

(51) Int. Cl.[7] ..... G03G 15/14; G03G 21/00

(52) U.S. Cl. ..... 399/101; 399/347; 399/352; 399/345

(58) Field of Search ..... 15/256.5, 256.51, 15/256.52; 399/101, 249, 327, 344, 346, 347, 348, 350, 351, 352, 353, 354, 355, 357, 358, 359, 360

(56) References Cited

U.S. PATENT DOCUMENTS 5,768,672 A * 6/1998 Van Herpen et al. ..... 399/327
5,970,281 A * 10/1999 Park ..... 399/101
6,347,212 B1 * 2/2002 Kosugi et al. ..... 399/348

* cited by examiner

*Primary Examiner*—Sophia S. Chen
*Assistant Examiner*—Hoang Ngo
(74) *Attorney, Agent, or Firm*—Dickstein, Shapiro, Morin & Oshinsky, LLP.

(57) ABSTRACT

A transfer roller cleaning mechanism 12 is brought into contact with a transfer roller 11 so as to remove a harmful substance contained in a developer remaining on the transfer roller 11 after a transfer step. Upon completion of printing of a predetermined number of pages, a fixation roller 13 is moved apart from the transfer roller 11 and a developed image for cleaning is formed over the entire printing area on a photosensitive body 1. This developed image is made into a film shape, which is transferred onto the transfer roller 11. The film-shaped developed image for cleaning is cleaned by the transfer roller cleaning mechanism 12.

14 Claims, 9 Drawing Sheets

*FIG.2(a)* PLAN VIEW
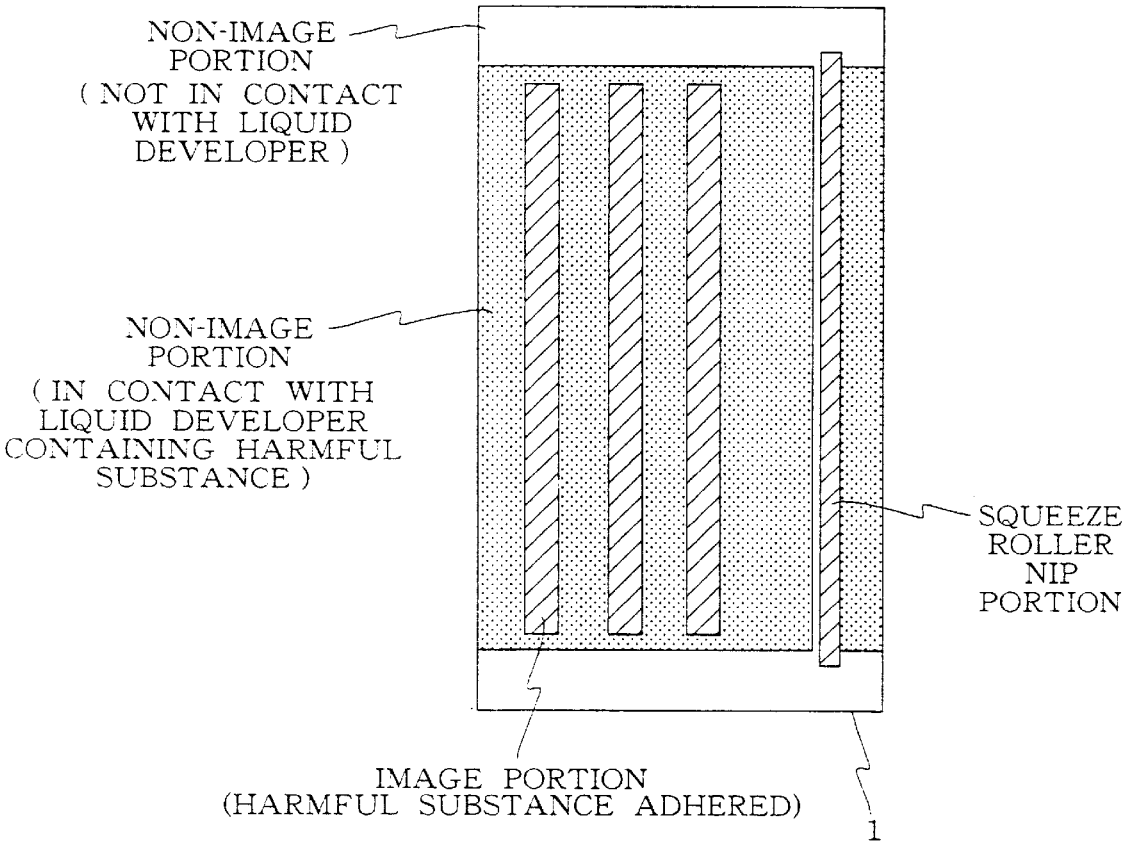
*FIG.2(b)* FRONT VIEW
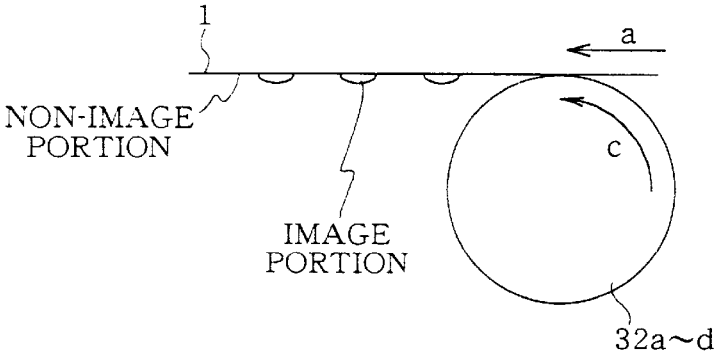

*1 DEVELOPING ROLLER IS DRIVEN TO ROTATE, VOLTAGE IS APPLIED TO DEVELOPING ROLLER AND SQUEEZE ROLLER, CHARGE IS TURNED ON, AND DEVELOPING UNIT IS AT PRINTING POSITION.

*2 DEVELOPING ROLLER STOPS, NO VOLTAGE IS APPLIED TO DEVELOPING ROLLER AND SQUEEZE ROLLER, CHARGER IS TURNED OFF, AND DEVELOPING UNIT IS AT STOP POSITION.

*1 DEVELOPING ROLLER IS DRIVEN TO ROTATE, VOLTAGE IS APPLIED TO DEVELOPING ROLLER AND SQUEEZE ROLLER, CHARGE IS TURNED ON, AND DEVELOPING UNIT IS AT PRINTING POSITION.

*2 DEVELOPING ROLLER STOPS, NO VOLTAGE IS APPLIED TO DEVELOPING ROLLER AND SQUEEZE ROLLER, CHARGER IS TURNED OFF, AND DEVELOPING UNIT IS AT STOP POSITION.

LIQUID-DEVELOPING ELECTRO-PHOTOGRAPHIC PRINTER PHOTOSENSITIVE BODY CLEANING METHOD

BACKGROUND OF THE INVENTION

1. Field of the Invention

The present invention relates to a liquid-developing electro-photographic printer photosensitive body cleaning method and in particular, to a liquid-developing electro-photographic printer photosensitive body cleaning method for removing harmful substance (viscous substance) from a photosensitive body using an existing transfer roller cleaning mechanism without providing a new mechanism for cleaning the photosensitive body.

2. Description of the Related Art

Conventionally, in this type of liquid-developing electro-photographic printer photosensitive body cleaning method, a harmful substance (viscous substance) contained in a liquid developer adheres to a photosensitive body during printing. That is, a portion of a film-shaped developed image formed on the photosensitive body from which solvent in the liquid developer is removed is transferred onto a transfer roller together with the harmful substance by the viscous force of the liquid developer and the photosensitive body is cleaned while a portion where no film-shaped developed image is formed leaves the harmful substance on the photosensitive body.

The harmful substance is accumulated in a great amount at the portion of the photosensitive body if no film-shaped developed image is formed for several hundred pages. After this, when a film-shaped developed image is formed at that portion having the harmful substance accumulated in a great amount, this film-shaped developed image cannot be transferred onto the transfer roller because the film-shaped developed image has a great viscous force with the harmful substance, resulting in a defective image.

Moreover, the photosensitive body is contaminated by the harmful substance accumulated in a great amount and its service life is reduced. Accordingly, it is necessary to remove this harmful substance from the photosensitive body.

SUMMARY OF THE INVENTION

It is therefore an object of the present invention to provide a liquid-developing electro-photographic printer photosensitive body cleaning method for removing harmful substance (viscous substance) from a photosensitive body using an existing transfer roller cleaning mechanism without providing a new mechanism for cleaning the photosensitive body.

The liquid-developing electro-photographic printer photosensitive body cleaning method according to the present invention is for use in a liquid-developing electro-photographic printer comprising: charging means for uniformly charging a photosensitive body surface; exposure means for optically forming a latent image on the photosensitive body surface charged; developing means for developing the latent image with a liquid developer to obtain a visible developed image; drying means for drying the developed image to obtain a film-shaped developed image; transfer/fixation means for transferring the film-shaped developed image from the photosensitive body onto a transfer roller opposed to the transfer roller and transferring/fixing the transferred image onto a paper inserted into a contact portion between the transfer roller and a fixation roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the enveloper remaining on a printing area of the photosensitive body and deteriorating the function of the photosensitive body, the mode including:

a step of moving the fixation roller apart from the transfer roller upon completion of printing of a predetermined number of pages;

a step of forming a developed image for cleaning over an entire printing area of the photosensitive body;

a step of making the developed image for cleaning into a film shape;

a step of transferring the film-shaped developed image for cleaning onto the transfer roller; and a step of cleaning the film-shaped developed image for cleaning using the transfer roller cleaning mechanism.

According to another aspect of the present invention, the liquid-developing electro-photographic printer photosensitive body cleaning method is for use in a liquid-developing electro-photographic printer comprising: charging means for uniformly charging a photosensitive body surface; exposure means for optically forming a latent image on the photosensitive body surface charged; developing means for developing the latent image with a liquid developer to obtain a visible developed image; drying means for drying the developed image to obtain a film-shaped developed image; transfer/fixation means for transferring the film-shaped developed image from the photosensitive body onto a transfer roller opposed to the transfer roller and transferring/fixing the transferred image onto a paper inserted into a contact portion between the transfer roller and a fixation roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the developer remaining on a printing area of the photosensitive body and deteriorating the function of the photosensitive body, the mode including:

a step of moving the fixation roller apart from the transfer roller upon completion of printing of a predetermined number of pages;

a step of moving the transfer roller cleaning mechanism apart from the transfer roller;

a step of forming a developed image for cleaning having a width of the printing area and a length equal to a circumference of the transfer roller on the photosensitive body;

a step of making the developed image for cleaning into a film shape and transferring the film-shaped developed image for cleaning onto the transfer roller, so that the film-shaped developed image for cleaning is adhered onto the entire surface of the transfer roller;

a step of removing harmful substance adhered to the photosensitive body by the viscous force of the film-shaped developed image for cleaning, from the photosensitive body by the transfer onto the transfer roller; and a step of pressing the transfer roller cleaning mechanism to the transfer roller so as to remove the film-shaped developed image for cleaning and the harmful substance from the transfer roller.

According to yet another aspect of the present invention, the liquid-developing electro-photographic printer photosensitive body cleaning method is for use in a liquid-developing electro-photographic printer comprising: charging means for uniformly charging a photosensitive body surface; exposure means for optically forming a latent image on the photosensitive body surface charged; developing means for developing the latent image with a liquid developer to obtain a visible developed image; drying means for drying the developed image to obtain a film-shaped developed image; transfer/fixation means for transferring the film-shaped developed image from the photosensitive body onto a transfer roller opposed to the transfer roller and transferring/fixing the transferred image onto a paper inserted into a contact portion between the transfer roller and a fixation roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the developer remaining on a printing area of the photosensitive body and deteriorating the function of the photosensitive body, the mode including:

a step of moving the fixation roller apart from the transfer roller upon completion of printing of a predetermined number of pages;

a step of spraying a liquid developer solvent onto the photosensitive body between the drying means and the transfer roller so as to weaken a bondage between a harmful substance and the photosensitive body;

a step of transferring the harmful substance onto the transfer roller; and a step of cleaning the transfer roller by the transfer roller cleaning mechanism.

BRIEF DESCRIPTION OF THE DRAWINGS

FIG. 2 shows a belt-shaped photosensitive body having a harmful substance adhered.

DESCRIPTION OF THE PREFERRED EMBODIMENTS

Description will now be directed to embodiments of the present invention with reference to the attached drawings.

Figure 1:
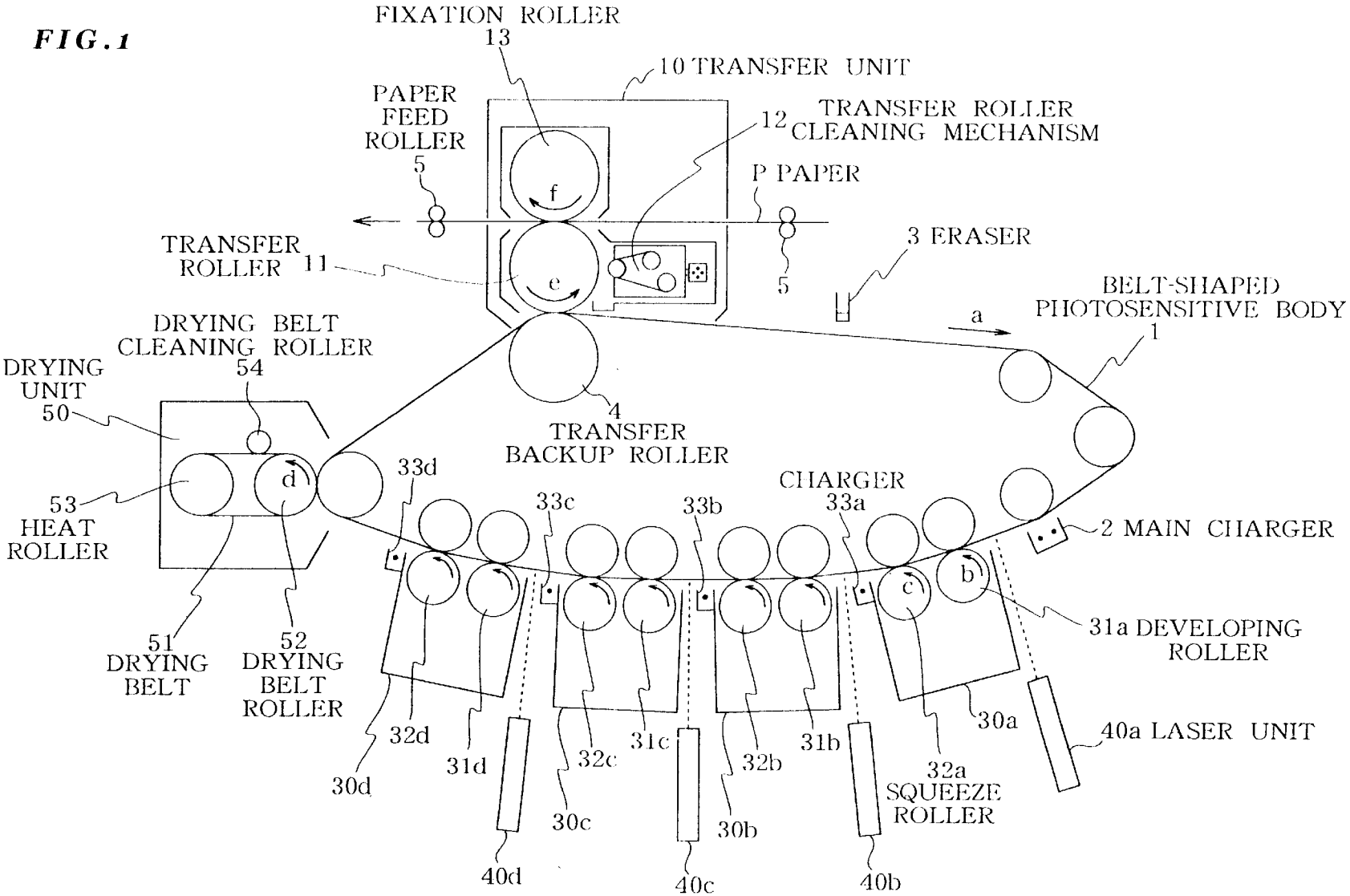
FIG. 1 shows an electro-photographic printer according to the present invention in a printing state.
Figure 3:
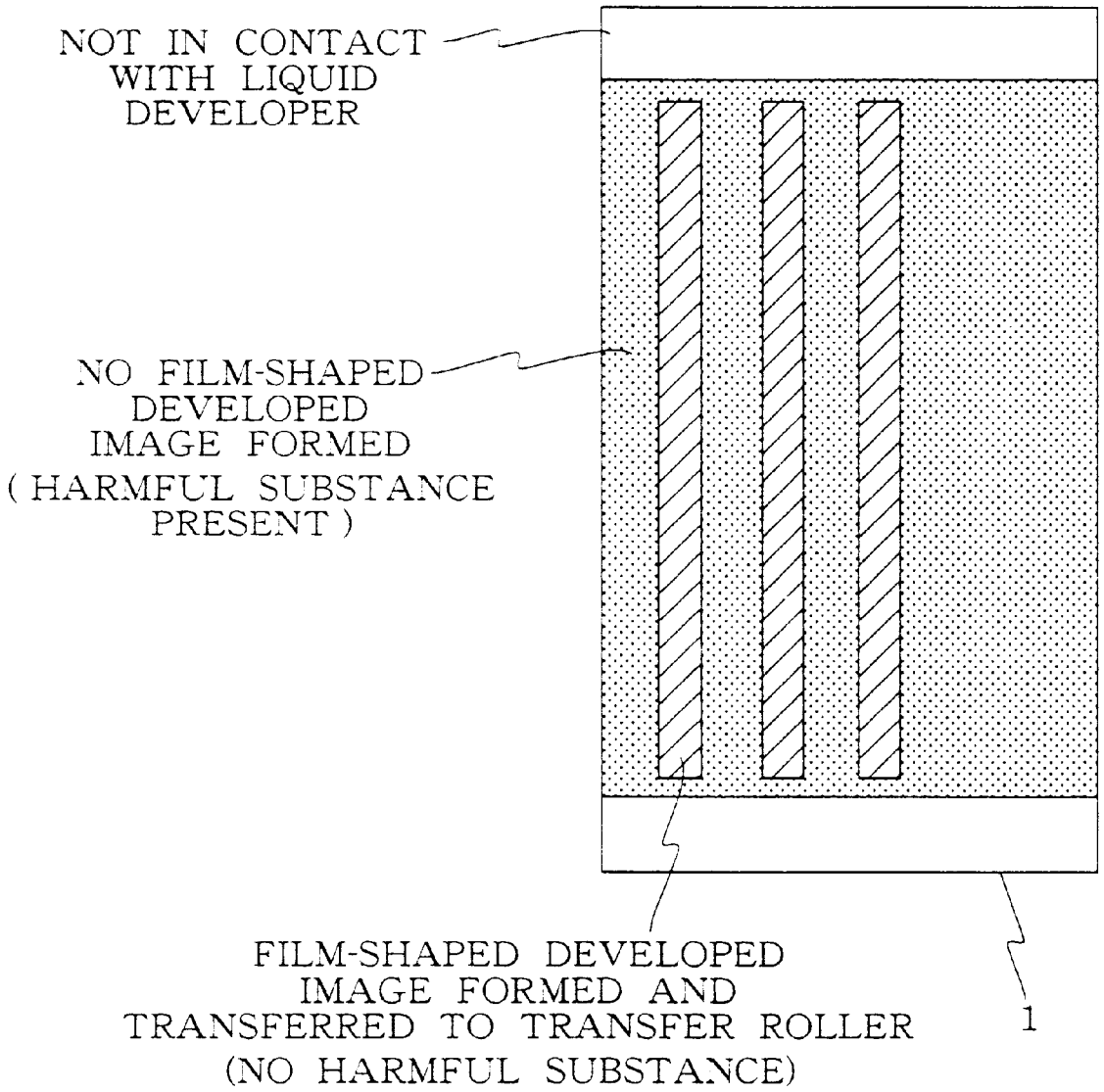
FIG. 3 shows the belt-shaped photosensitive body after a transfer operation.

FIG. 1 shows a configuration example of a liquid-developing color electro-photographic printer used in the present invention. The liquid-developing color electro-photographic printer includes a belt-shaped photosensitive body 1 surrounded by a main charger 2 and chargers 33*a*, 33*b*, 33*c*, and 33*d* as charging means, laser units 40*a*, 40*b*, 40*c*, and 40*d* as exposure means, developing units 30*a*, 30*b*, 30*c*, and 30*d* as developing means, a drying unit 50 as drying means, and a transfer unit 10 as transfer/fixation means for the four colors of yellow, cyan, magenta, and black. Using these mechanisms, an image is printed on a paper P fed by a paper feed roller 5 through a series of electro-photographic process.

The developing units 30*a* to 30*d* includes developing rollers 31*a*, 31*b*, 31*c*, and 31*d* as cylindrical metal members, each of which is rotatably supported at both ends by roller support bodies (not depicted). During printing operation, developing voltage is supplied from the shaft end portion to the developing rollers 31*a* to 31*d* which are arranged at a position to keep a small gap of 150 [micrometers] against the belt-shaped photosensitive body 1. Moreover, the developing rollers 31*a* to 31*d* are driven to rotate in the direction indicated by arrow "b" and a liquid developer supplied is fed to this small gap so as to develop an electrostatic latent image formed on the belt-shaped photosensitive body 1. The developing rollers 31*a* to 31*d* are moved apart from the belt-shaped photosensitive body 1 immediately before the printer enters a stop mode upon completion of the printing operation.

Squeeze rollers 32*a*, 32*b*, 32*c*, and 32*d* are cylindrical members having a width (length) greater than the developing rollers 32*a* to 32*d* and each including a roller portion made from a semiconductor urethane rubber (resistance 1×105 to 1×109 [.cm]) and a shaft portion as a metal member. Each of the squeeze rollers 32*a* to 32*d* is rotatably supported at both ends by roller support bodies (not depicted). During a printing operation, a squeeze voltage is applied from the shaft end of the squeeze rollers 32*a* to 32*d* and a compression coil spring contained in the roller support bodies (not depicted) presses the squeeze rollers 32*a* to 32*d* against the belt-shaped photosensitive body 1 with a predetermined force so that the squeeze rollers 32*a* to 32*d* are rotated in the direction indicated by c by the friction with the belt-shaped photosensitive body 1 while removing an excessive liquid developer remaining after development on the belt-shaped photosensitive body 1. The squeeze rollers 32*a* to 32*d* are moved apart from the belt-shaped photosensitive body 1 immediately before the printer enters the stop mode upon completion of the printing operation.

The drying belt is a PET (polyethylene terephthalate) substrate coated by a substance absorbing a solvent of the liquid developer. During a printing operation, this drying belt 51 is pressed by a drying belt roller 52 with a predetermined force against the belt-shaped photosensitive body 1 and rotated in the direction indicated by the arrow "d" by the friction force with the belt-shaped photosensitive body 1 while absorbing an excessive liquid developer. When the portion of the drying belt 51 which has absorbed the liquid developer comes to a heat roller 53, the absorbed liquid developer evaporates. A drying belt cleaning roller 54 cleans the contamination adhered to the drying belt 51. When the printing operation is complete, the drying belt 51 is moved apart from the belt-shaped photosensitive body 51.

The transfer roller 11 is a metal pipe coated by a silicone rubber. During a printing operation, the transfer roller 11 is pressed by the transfer backup roller 4 with a predetermined force against the belt-shaped photosensitive body 1 so as to fetch an image from the belt-shaped photosensitive body 1 and the image is transferred onto the paper P. When the printing operation is complete, the transfer roller 11 is moved apart from the belt-shaped photosensitive body 1.

Figure 5:
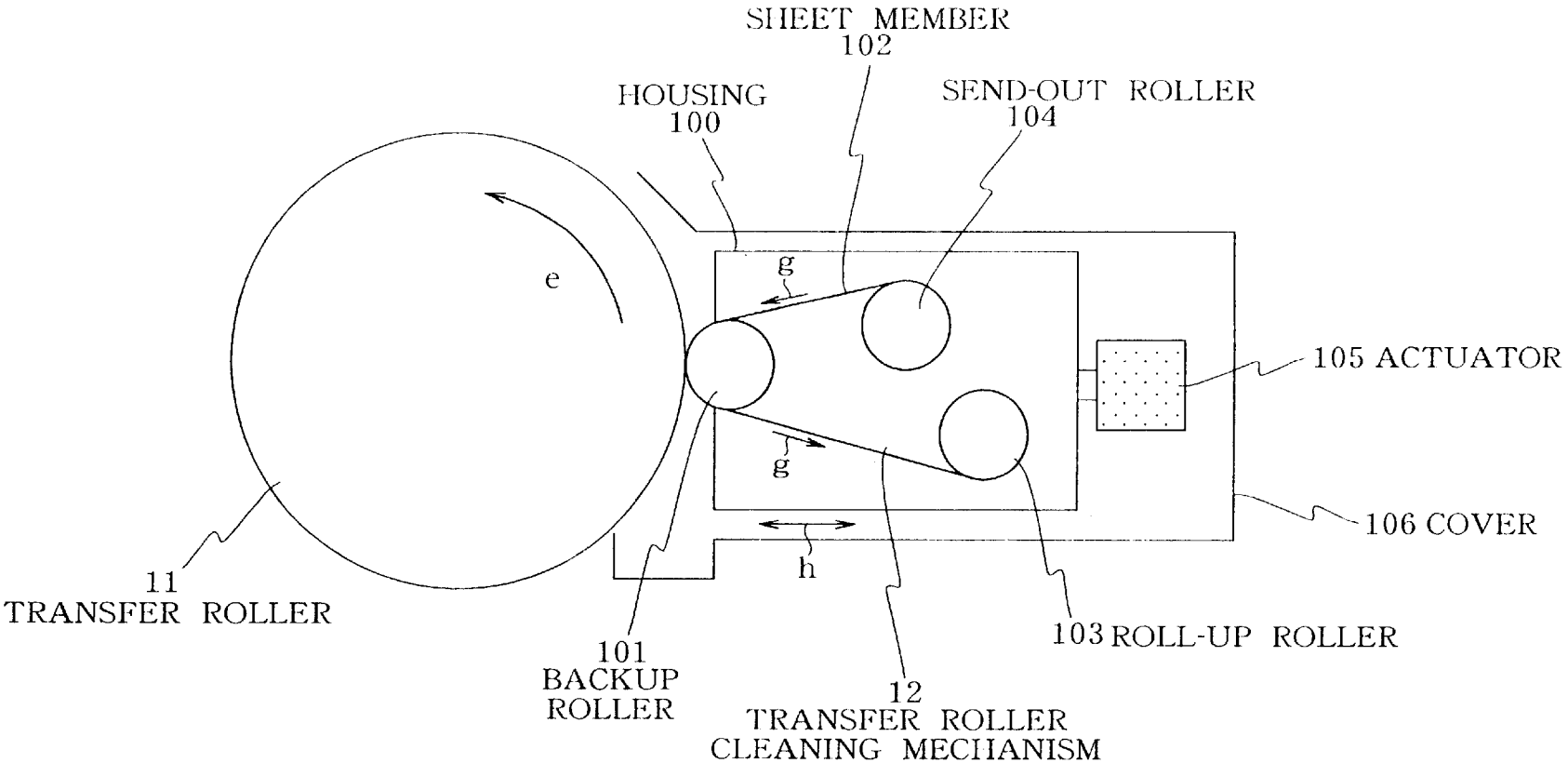
FIG. 5 shows a detailed configuration of a transfer roller cleaning mechanism of the electro-photographic printer according to the present invention.

FIG. 5 shows a configuration of the transfer roller cleaning mechanism 12 for cleaning the transfer roller 11. Referring to FIG. 5, the transfer roller cleaning mechanism 12 includes: a backup roller 101 arranged in a pressed manner against the transfer roller 11; a sheet member 102 inserted between the backup roller 101 and the transfer roller 11 for cleaning the transfer roller 11; a feed-out roller for feeding out this sheet member 102; a roll-up roller 103 for rolling up this sheet member 102; a housing 100 for holding the feed-out roller 104, the roll-up roller 103, and the sheet member 102; an actuator 105 connected to the housing 100 for connecting and disconnecting the housing 100 in the direction indicated by the arrow "h", i.e., toward/from the transfer roller 11; and a cover 106 for receiving scraped dust as result of cleaning of the transfer roller 11.

The sheet member 102 is a lapping film 661X (trade name) produced by 3M Co., Ltd. which includes a PET substrate on which particles of silicon carbide having a particle diameter of 15 [micrometers] are arranged. When the cleaning mode is set in, the sheet member 102 is pressed with a predetermined force against the transfer roller 11 so as to clean the transfer roller 11. When the belt-shaped photosensitive body cleaning mode is complete, the sheet member 102 and the backup roller 101 are moved apart from the transfer roller 11.

Description will now be directed to an operation of the aforementioned liquid-developing color electrophotographic printer with reference to FIG. 1 to FIG. 7.

When a printing data is entered, the drying belt 51 is pressed with a force of 12 [kgf] against the belt-shaped photosensitive body 1 and the transfer roller 11 is pressed with a force of 60 [kgf] against the belt-shaped photosensitive body 1. The belt-shaped photosensitive body 1 is moved in the direction indicated by the arrow "a" and charged by the main charger 2 with +750 [V] (FIG. 1). Here, the drying belt 51 is rotated in the direction indicated by the arrow "d" while the transfer roller 11 is rotated in the direction indicated by the arrow "e" following the movement of the belt-shaped photosensitive body 1.

After this, a liquid developer circulation pump (not depicted) starts operation to supply a plus-charged liquid developer to the developing rollers 32*a* to 32*d* which are driven to rotate in the direction indicated by the arrow "b". A voltage of +450 [V] is applied to the developing rollers 32*a* to 32*d* and a voltage of +450 [V] is successively applied to the squeeze rollers 32*a* to 32*d* (in the order to the yellow developer 30*a*, the cyan developer 30*b*, the magenta developer 30*c*, and the black developer 30*d*). Simultaneously with this, the chargers 33*a* to 33*d* are turned on (the belt-shaped photosensitive body 1 is charged to +750 [V]).

Next, a cam (not depicted) rotates to move the developers 30*a* to 30*d* vertically so as to successively raise the yellow developer 30*a*, the cyan developer 30*b*, the magenta developer 30*c*, and the black developer 30*d* from the stop position to the printing position. When these developers 30*a* to 30*d* are raised to the printing position, the developing rollers 32*a* to 32*d* are positioned against the belt-shaped photosensitive body 1 with the gap of 150 [micrometers].

The squeeze rollers 32*a* to 32*d* are pressed with a force of 30 [kgf] by the pressing spring against the belt-shaped photosensitive body 1. Here, the squeeze rollers 32*a* to 32*d* are rotated in the direction indicated by the arrow "c" following the belt-shaped photosensitive body 1.

Next, the laser units 40*a* to 40*d* perform an exposure process (the exposure block potential becomes +150 [V]) and an electrostatic latent image is formed on the belt-shaped photosensitive body 1.

The liquid developer supplied to the developing rollers 32*a* to 32*d* is carried to the 150 [micrometers] gap (a developing nip block) between the belt-shaped photosensitive body 1 and the developing rollers 32*a* to 31*d* while the developing rollers 32*a* to 32*d* are rotated in the direction indicated by the arrow "b". When the electrostatic latent image on the belt-shaped photosensitive body 1 reaches this gap, the electrostatic latent image is developed by an electric field between the belt-shaped photosensitive body 1 and the developing rollers 32*a* to 32*d* (potential difference between the exposure portion potential +150 [V] of the belt-shaped photosensitive body 1 and the developing roller potential +450 [V]). An excessive liquid developer remaining on the belt-shaped photosensitive body 1 immediately after the development is removed by the squeeze rollers 32*a* to 32*d* pressed with a force of 30 [kgf] against the belt-shaped photosensitive body 1 and supplied with a voltage of +450 [V]. An image on the belt-shaped photosensitive body 1 becomes a film-shaped image. The belt-shaped photosensitive body 1 is again charged by the chargers 33*a* to 33*d* to +750 [V] for the exposure process and the development process of the next color (the exposure/development process is performed for yellow, cyan, magenta, and black in this order).

The film-shaped image on the belt-shaped photosensitive body 1 which has passed through the black developer 30*d* advances to the drying unit 50 so that the drying belt 51 absorbs an excessive liquid developer and the image is dried. The liquid developer absorbed by the drying belt 51 is evaporated by the heat roller 53, and the evaporated portion is collected into a solvent tank (not depicted).

After this, the image on the belt-shaped photosensitive body 1 advances toward the transfer unit 10 and is pressed with a force of 60 [kgf] against the belt-shaped photosensitive body 1 so as to be transferred onto the transfer roller 11 rotating in the direction indicated by the arrow "e". Here, the fixation roller 13 is in contact with the transfer roller 11 and is rotated in the direction indicated by the arrow "f". The paper P is fed to the contact portion between the fixation roller 13 and the transfer roller 11 and the image is transferred from the transfer roller 11 onto the paper P and fixed there.

After the belt is transferred, an eraser 3 removes electric charge from the belt-shaped photosensitive body 1 and the belt-shaped photosensitive body 1 becomes potentially uniform (about +30 [V]). The belt-shaped photosensitive body 1 again charged by the main charger 2 up to +750 [V] and the same process is repeated.

As shown in FIG. 2, during a printing operation, when the belt-shaped photosensitive body is brought into contact with the liquid developer, a harmful substance adheres to the belt-shaped photosensitive body 1. When the portion of the belt-shaped photosensitive body having the liquid developer passes through the drying unit 50 to reach the transfer unit 10, an image portion, i.e., a film-shaped developed image formed on the surface of the belt-shaped photosensitive body 1 after the solvent is removed from the liquid developer, is transferred to the transfer roller 11 together with the harmful substance due to the viscous force of the liquid developer and that portion of the belt-shaped photosensitive body 1 is cleaned. However, the harmful substance remains on the other portion, i.e., non-image portion (FIG.

3). If no film-shaped developed image is formed in that portion after this, the harmful substance is accumulated. When the amount of the harmful substance reaches a certain amount, a film-shaped developed image formed in that portion cannot be transferred from the belt-shaped photosensitive body 1 to the transfer roller 11.

To solve this problem, when printing of a predetermined number of sheets of paper is complete, an image pattern capable of forming a film-shaped developed image over the entire area where printing can be performed is developed to form a film-shaped developed image and all the harmful substances adhered to the printing area of the belt-shaped photosensitive body 1 are transferred together with the film-shaped developed image to the transfer roller 11. This is the belt-shaped photosensitive body cleaning mode by which the present invention is characterized. In this case, a film-shaped developed image (containing harmful substance) is transferred and the aforementioned transfer roller cleaning mechanism 12 is used.

Next, explanation will be given on a first embodiment of the present invention with reference to FIG. 1, FIG. 4, FIG. 5, FIG. 6, and FIG. 7. The first embodiment is characterized in the photosensitive cleaning mode, during which a developed image for cleaning is formed over the entire printing area of the photosensitive body 1 and the developed film for cleaning is film-shaped, which is transferred to the transfer roller 11 and the film-shaped developed image for cleaning is cleaned by the transfer roller cleaning mechanism 12.

Figure 4:
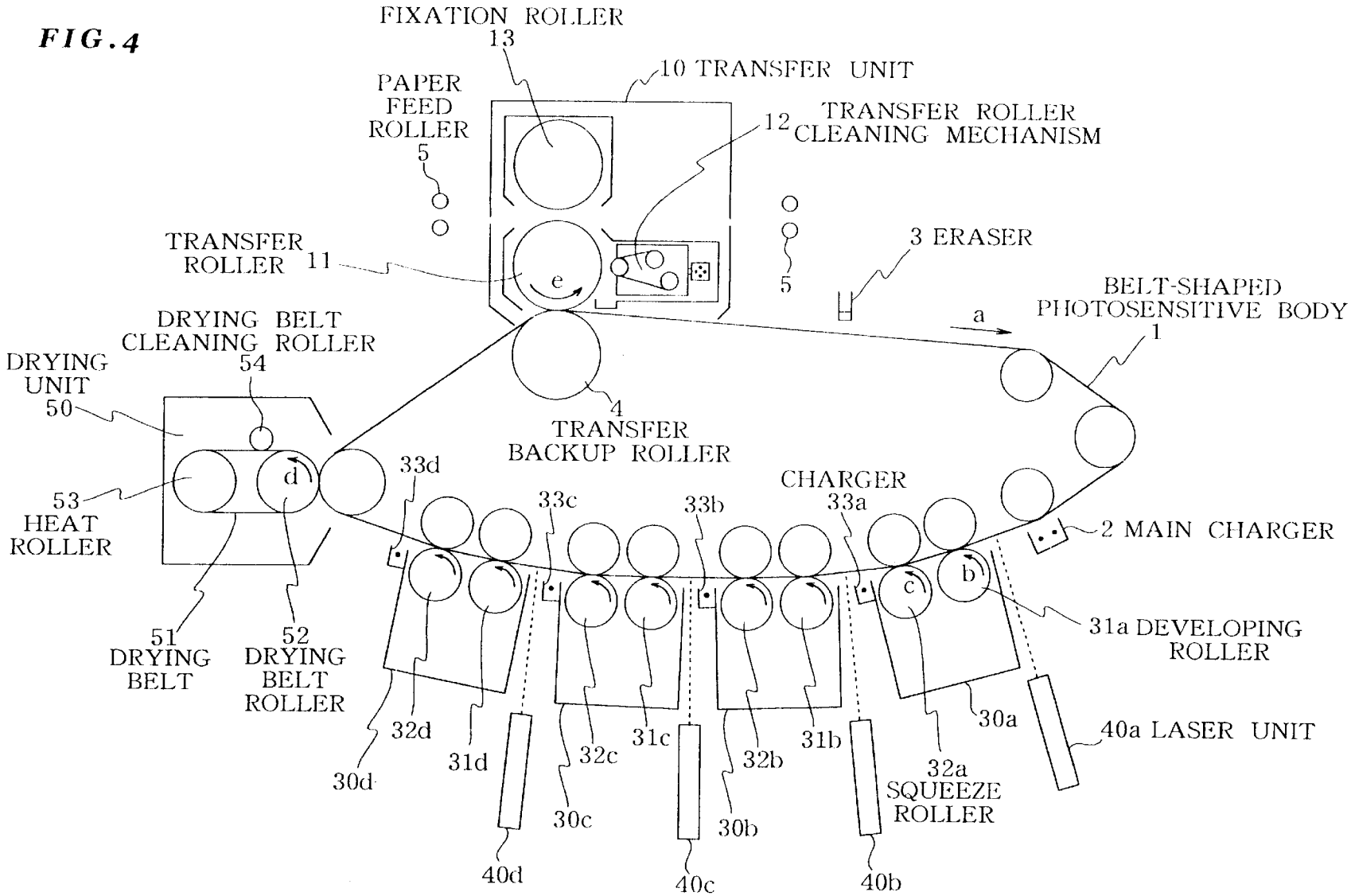
FIG. 4 shows the electro-photographic printer in a belt-shaped photosensitive body cleaning mode.

After completion of a series of electronic photo process to print 200 pages, the belt-shaped photosensitive cleaning mode is set in (FIG. 4). Firstly, the fixation roller 13 is moved apart from the transfer roller 11, the sheet member 102 is pressed with a force of 10 [kgf] by the actuator 105. A black solid pattern is developed over the entire printing area and the developer is formed into a film shape, which is transferred to the transfer roller 11. Here, the harmful substance adhered to the printing area is also transferred by the viscous force of the film-shaped developed image. The film-shaped developed image transferred onto the transfer roller 11 is removed by a sliding portion of the sheet member 102. The film-shaped developed image transferred onto the transfer roller 11 advances to the sliding portion of the sheet member 102 and is removed. The surface of the transfer roller 11 which has passed this sliding portion is clean. After the film-shaped developed image and the harmful substance are transferred from the belt-shaped photosensitive body 1 to the transfer roller 11 and the film-shaped developed image and the harmful substance are removed from the transfer roller 11, the sheet member 102 is removed from the transfer roller 11 by the actuator 105 and the roll up roller 103 is rotated by a predetermined angle to roll up the sheet member 102 in the direction indicated by the arrow "g", after which a printing operation is started.

After the belt-shaped photosensitive body cleaning mode, 200 pages are printed and again the belt-shaped photosensitive body cleaning mode is set in.

Figure 6:
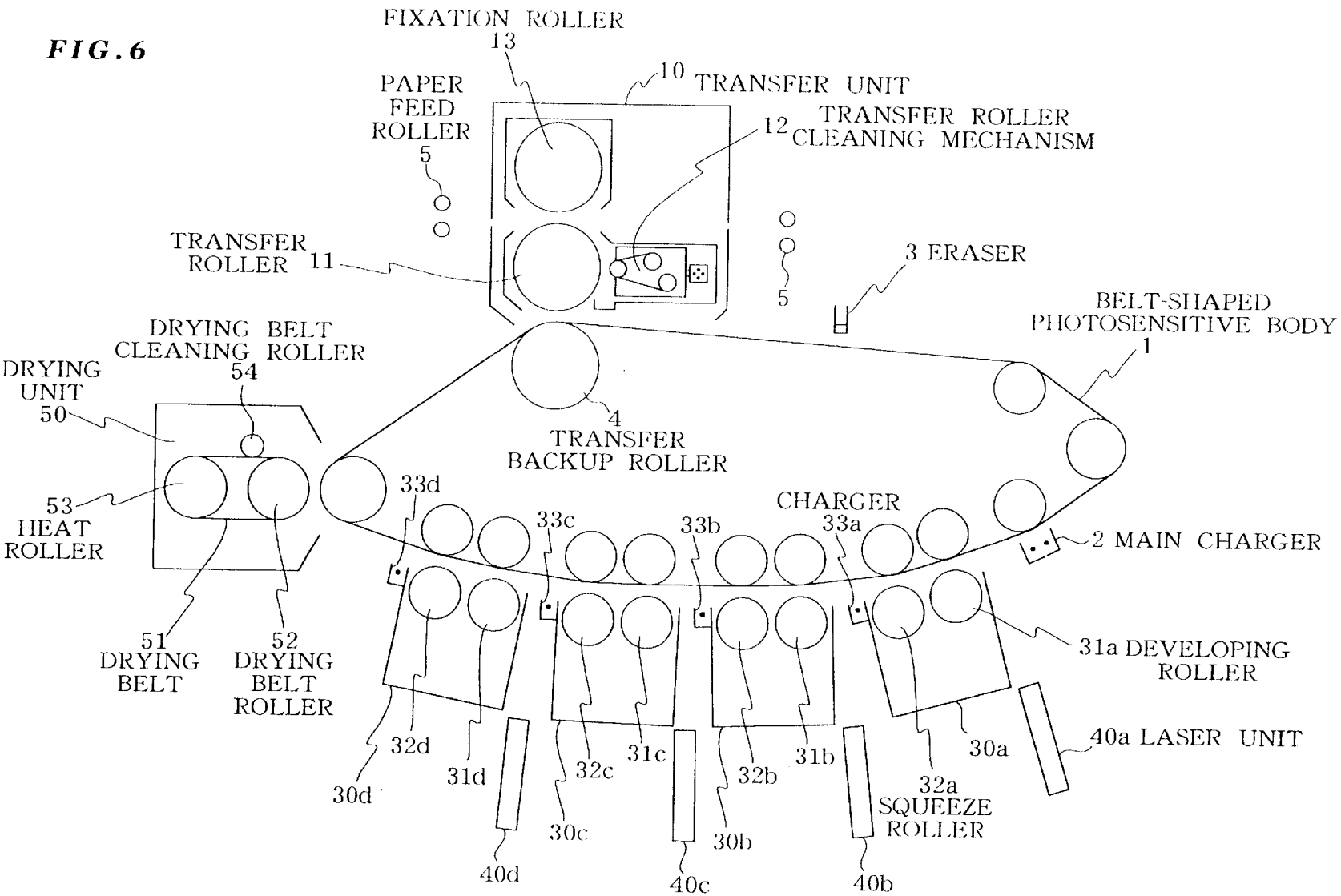
FIG. 6 shows the electro-photographic printer in a stop mode.
Figure 7:
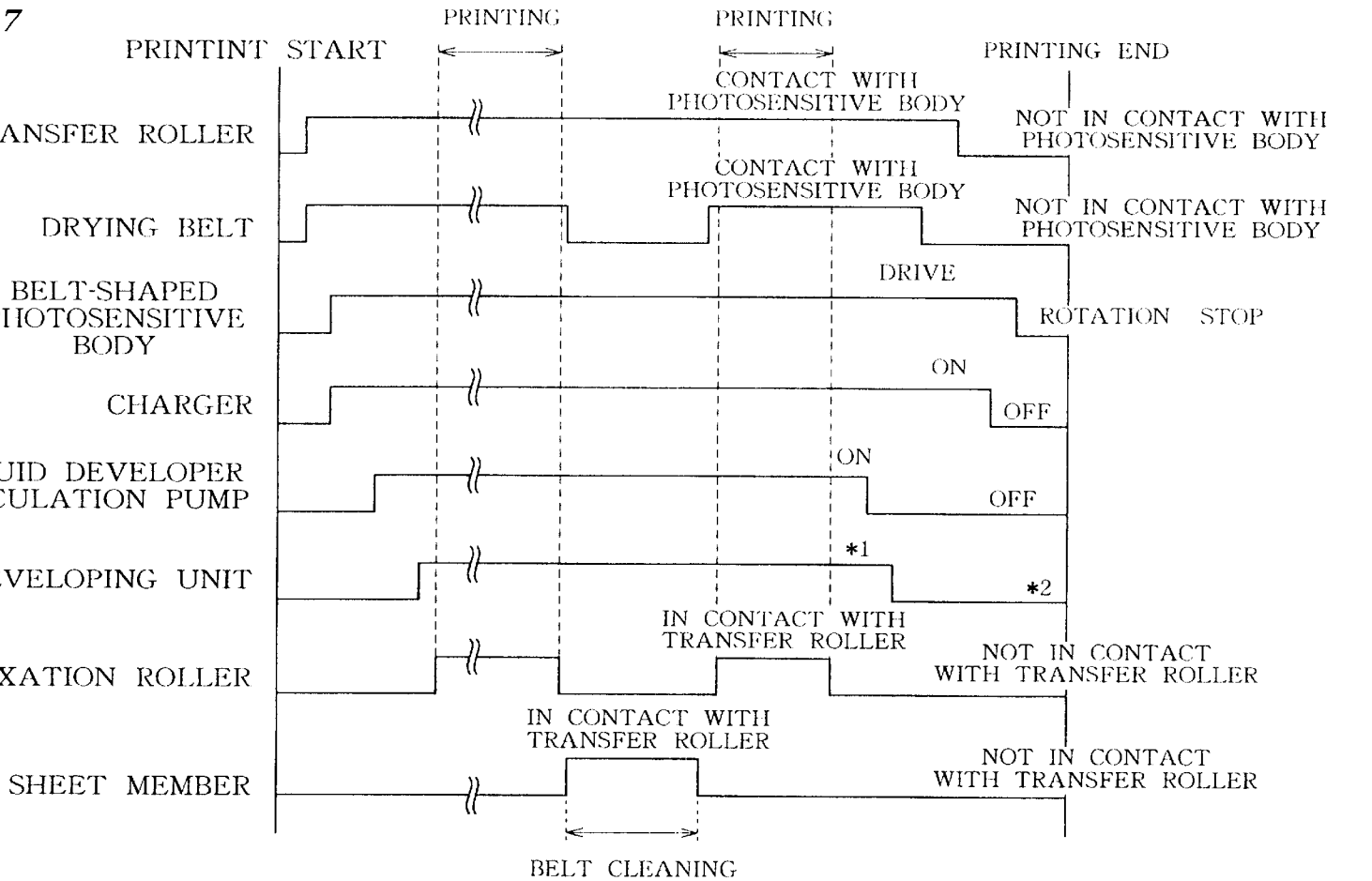
FIG. 7 shows an operation sequence according to a first embodiment.

Upon completion of the printing, as shown in FIG. 6 and FIG. 7, the liquid developer circulation pump (not depicted) supplying the liquid developer stops and the cam (not depicted) vertically moving the developing units 30*a* to 30*d* rotates so that the developing units 30*a* to 30*d* are lowered to the printer stop position and the developing rollers 32*a* to 32*d* successively stop their rotations (in the order of the yellow developing unit 30*a*, the cyan developing unit 30*b*, the magenta developing unit 30*c*, and the black developing unit 30*d*). After this, the fixation roller 13 moves apart from the transfer roller 11 and then the transfer roller 11 and the drying belt 51 move apart from the belt-shaped photosensitive body 1. All the voltages applied and the chargers are turned off. Lastly, the belt-shaped photosensitive body 1 stops.

The aforementioned pattern to be developed in the entire printing area during the belt-shaped photosensitive cleaning mode may be any pattern that can be developed over the entire printing area. For example, a yellow solid patter, a cyan solid pattern, or a magenta solid pattern may be used. It is also possible to use liquid developers of two colors to develop 50% of the printing area by each of the color or to use liquid developers of four colors to develop 25% of the printing area by each of the colors.

Referring to FIG. 4 and FIG. 5, explanation will be given on a liquid-developing electro-photographic printer photosensitive body cleaning method according to a second embodiment of the present invention. The transfer roller cleaning mechanism 12 is moved apart from the transfer roller 11 and an image for cleaning having a width of the printing area and a length equal to a circumference of the transfer roller 11 is developed on the photosensitive body 1 and the developed image for cleaning is made into a film shape, which is transferred to the transfer roller 11, so that the film-shaped developed image for cleaning adheres to the entire circumference of the transfer roller 11. The harmful substance adhered to the photosensitive body 1 is transferred onto the transfer roller 11 by the viscous force of the film-shaped developed image for cleaning which has been transferred onto the transfer roller 11. After the harmful substance is completely removed from the photosensitive body 1, the transfer roller cleaning mechanism 12 is pressed against the transfer roller 11 so as to remove the film-shaped developed image for cleaning and the harmful substance from the transfer roller 11. This is the photosensitive body cleaning mode of the second embodiment.

When the belt-shaped photosensitive body cleaning mode is set in, the fixation roller 13 is moved apart from the transfer roller 11 and without pressing the sheet member 102 for cleaning the transfer roller 11 against the transfer roller 11, a solid pattern having the width of the entire printing area and the length equal to a circumference of the transfer roller 11 is developed on the belt-shaped photosensitive body 1. The developed pattern is made into a film shape and transferred to the transfer roller 11 (so that the film-shaped developed image is adhered to the entire circumference of the transfer roller 11). By the viscous force of the film-shaped developed image transferred to the transfer roller 11, the harmful substance is removed from the belt-shaped photosensitive body. After this, when the harmful substance on the belt-shaped photosensitive body 1 is completely removed, the sheet member 102 is pressed against the transfer roller 11 so as to remove the film-shaped developed image and the harmful substance from the transfer roller 11. In this case, the film-shaped developed image formed has a length equal to only a circumference of the transfer roller 11 and accordingly, the amount of the liquid developer consumed in the belt-shaped photosensitive body cleaning mode can be reduced as compared to the first embodiment. (In the first embodiment, four pages of A4 size paper are printed with one turn of the belt, consuming a fairly large amount of the liquid developer).

Figure 8:
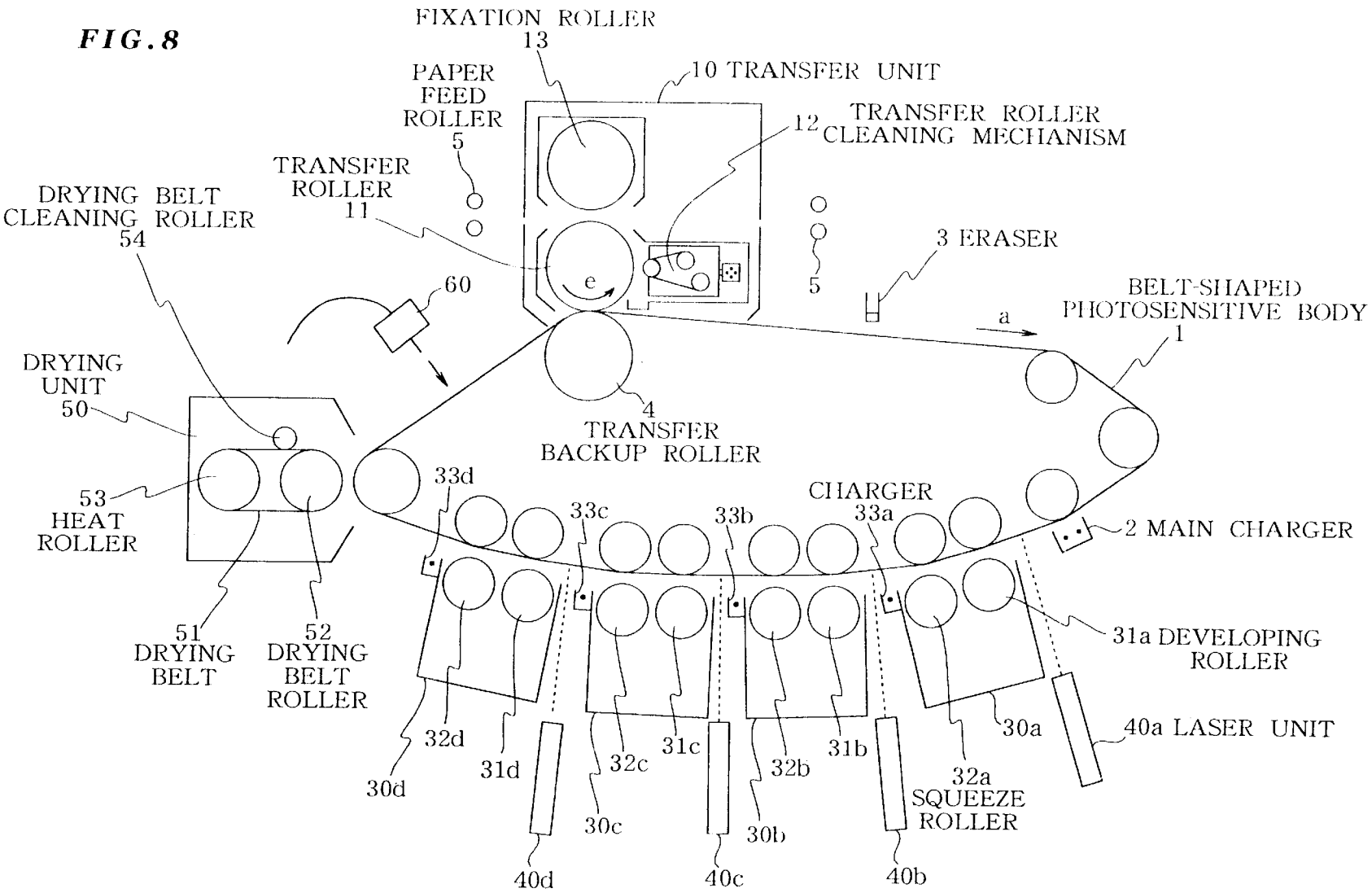
FIG. 8 explains a third embodiment.
Figure 9:
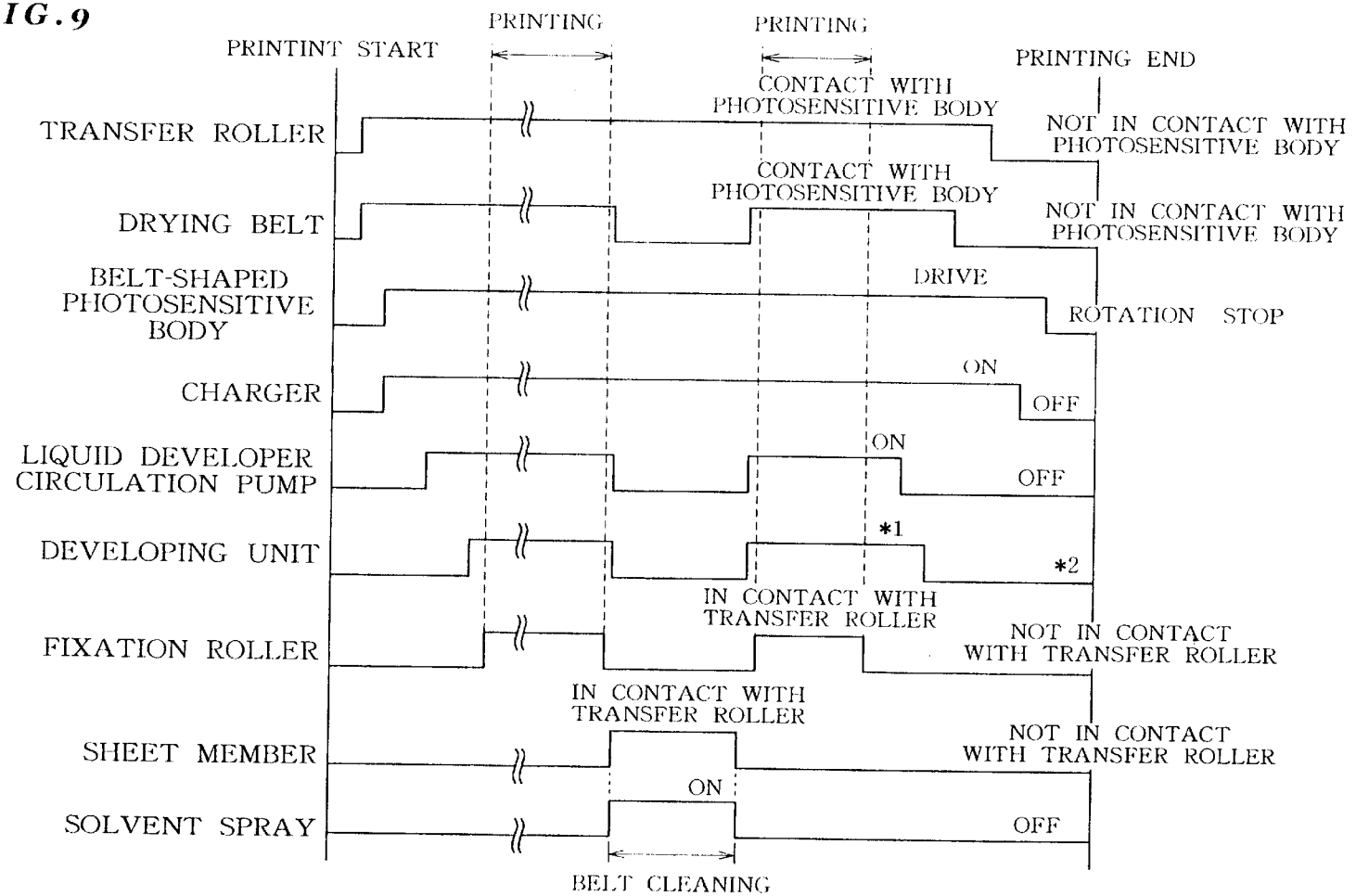
FIG. 9 shows an operation sequence of the third embodiment.

Referring to FIG. 8 and FIG. 9, explanation will be given on a third embodiment of the liquid-developing electro-photographic printer photosensitive body cleaning method. The photosensitive body cleaning mode according to the third embodiment is realized as follows. A liquid developer solvent is applied in spray to the photosensitive body 1 between the drying unit 50 and the transfer roller 11, so as to weaken the bondage between the harmful substance and the photosensitive body 1 and transfer the harmful substance onto the transfer roller 11, after which the transfer roller 11 is cleaned by the transfer roller cleaning mechanism 12.

A film-shaped developed image on the belt-shaped photosensitive body which has passed through the drying unit 50 still contains some liquid developer solvent and is not completely dried. The bondage between the belt-shaped photosensitive body 1 and the film-shaped developed image is small and the bondage between the belt-shaped photosensitive body 1 and harmful substance present in the film-shaped developed image portion is also small. Accordingly, the film-shaped developed image and the harmful substance are transferred to the transfer roller 11. However, the other portion where no film-shaped developed image is present contains almost no liquid developer solvent and is completely dried. In this portion, the bondage between the harmful substance and the belt-shaped photosensitive body is strong. For this, the harmful substance in the portion having no film-shaped developed image remains and is accumulated on the belt-shaped photosensitive body 1, causing a defective image. To solve this problem, when printing of a predetermined pages is complete, the liquid developer solvent recovered by the drying unit 50 is applied in spray by a solvent spray nozzle 60 onto the belt-shaped photosensitive body 1 so as to weaken the bondage between the harmful substance and the belt-shaped photosensitive body 1 and to transfer the harmful substance onto the transfer roller 11. Then, the transfer roller 11 is cleaned by the transfer roller cleaning mechanism 12. In this case, a pure solvent is sprayed instead of a liquid developer. In the case of a liquid developer, it also contains a harmful substance, has insufficient capability to weaken the bondage, and cannot clean the belt-shaped photosensitive body 1.

This third embodiment will be detailed with reference to FIG. 8 and FIG. 9. Upon completion of printing of a predetermined number of pages, the fixation roller 13 is moved apart from the transfer roller 11 and the squeeze rollers 32*a* to 32*d* and the drying belt 51 are moved apart from the belt-shaped photosensitive body 1. Moreover, the sheet member 102 is pressed against the transfer roller 11 and the liquid developer circulation pump (not depicted) is stopped. The solvent of the liquid developer recovered by the drying unit 50 into a solvent tank (not depicted) during a printing is sprayed from the solvent spray nozzle 60 onto the belt-shaped photosensitive body 1. This weakens the bondage between the belt-shaped photosensitive body 1 and the harmful substance and the harmful substance is transferred onto the transfer roller 11. The harmful substance adhered to the transfer roller 11 is removed from the transfer roller 11 by the transfer roller cleaning mechanism 12.

While the first, the second, and the third embodiment have been explained using the photosensitive body as a belt-shaped photosensitive body, these embodiments can also be realized when a drum-shaped photosensitive body is used.

As has been described above, according to the present invention, upon completion of printing of a predetermined number of pages, the photosensitive body cleaning mode is set in, thereby preventing an image defect caused by harmful substance adhered and accumulated on the photosensitive body. Moreover, this prevents deterioration of the photosensitive body due to the contamination by the harmful substance adhered to the photosensitive body, thereby increasing the service life of the photosensitive body.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2000-037909 (Filed on Feb. 16$^{th}$, 2000) including specification, claims, drawings and summary are incorporated herein by reference in its entirety.

What is claimed is:

1. A liquid-developing electro-photographic printer photosensitive body cleaning method for use in a liquid-developing electro-photographic printer comprising:

charging means for uniformly charging a photosensitive body surface; exposure means for optically forming a latent image on the photosensitive body surface charged; developing means for developing the latent image with a liquid developer to obtain a visible developed image;

drying means for drying the developed image to obtain a film-shaped developed image; transfer/fixation means for transferring the film-shaped developed image from the photosensitive body onto a transfer roller and transferring/fixing the transferred image onto a paper inserted into a contact portion between the transfer roller and a fixation roller opposed to the transfer roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the developer remaining on a printing area of the photosensitive body and deteriorating the function of the photosensitive body, the mode including:

a step of moving the fixation roller apart from the transfer roller upon completion of printing of a predetermined number of pages;

a step of forming a developed image for cleaning over an entire printing area of the photosensitive body;

a step of making the developed image for cleaning into a film shape;

a step of transferring the film-shaped developed image for cleaning onto the transfer roller; and a step of cleaning the film-shaped developed image for cleaning using the transfer roller cleaning mechanism.

2. A liquid-developing electro-photographic printer photosensitive body cleaning method for use in a liquid-developing electro-photographic printer comprising:

charging means for uniformly charging a photosensitive body surface; exposure means for optically forming a latent image on the photosensitive body surface charged; developing means for developing the latent image with a liquid developer to obtain a visible developed image;

drying means for drying the developed image to obtain a film-shaped developed image; transfer/fixation means for transferring the film-shaped developed image from the photosensitive body onto a transfer roller and transferring/fixing the transferred image onto a paper inserted into a contact portion between the transfer roller and a fixation roller opposed to the transfer roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the developer remaining on a printing area of the photosensitive body and deteriorating the function of the photosensitive body, the mode including:

a step of moving the fixation roller apart from the transfer roller upon completion of printing of a predetermined number of pages;

a step of moving the transfer roller cleaning mechanism apart from the transfer roller;

a step of forming a developed image for cleaning having a width of the printing area and a length equal to a circumference of the transfer roller on the photosensitive body;

a step of making the developed image for cleaning into a film shape and transferring the film-shaped developed image for cleaning onto the transfer roller, so that the film-shaped developed image for cleaning is adhered onto the entire surface of the transfer roller;

a step of removing harmful substance adhered to the photosensitive body by the viscous force of the film-shaped developed image for cleaning, from the photosensitive body by the transfer onto the transfer roller; and a step of pressing the transfer roller cleaning mechanism to the transfer roller so as to remove the film-shaped developed image for cleaning and the harmful substance from the transfer roller.

3. A liquid-developing electro-photographic printer photosensitive body cleaning method for use in a liquid-developing electro-photographic printer comprising:

charging means for uniformly charging a photosensitive body surface; exposure means for optically forming a latent image on the photosensitive body surface charged; developing means for developing the latent image with a liquid developer to obtain a visible developed image;

drying means for drying the developed image to obtain a film-shaped developed image; transfer/fixation means for transferring the film-shaped developed image from the photosensitive body onto a transfer roller and transferring/fixing the transferred image onto a paper inserted into a contact portion between the transfer roller and a fixation roller opposed to the transfer roller; these means being arranged around the photosensitive body, wherein a transfer roller cleaning mechanism is provided arranged in contact with the transfer roller so as to remove a harmful substance contained in a developer remaining on the transfer roller after a transfer step and deteriorating a function of the transfer roller, the method comprising a photosensitive body cleaning mode for removing a harmful substance contained in the developer remaining on a printing area of the photosensitive body and deteriorating the function of the photosensitive body, the mode including:

a step of moving the fixation roller apart from the transfer roller upon completion of printing of a predetermined number of pages;

a step of spraying a liquid developer solvent onto the photosensitive body between the drying means and the transfer roller so as to weaken a bondage between a harmful substance and the photosensitive body;

a step of transferring the harmful substance onto the transfer roller; and a step of cleaning the transfer roller by the transfer roller cleaning mechanism.

4. The liquid-developing electro-photographic printer photosensitive body cleaning method as claimed in claim 1, wherein the transfer roller cleaning mechanism comprises:

a backup roller to be pressed against the transfer roller when cleaning the transfer roller;

a sheet material inserted between the backup roller and the transfer roller so as to clean the transfer roller;

a send-out roller for sending out the sheet material;

a roll-up roller for rolling up the sheet material;

a housing for holding the send-out roller, the roll-up roller, and the sheet material;

an actuator connected to the housing for pressing and disconnecting the housing to/from the transfer roller; and a cover for receiving scraped dust as a result of cleaning of the transfer roller.

5. The liquid-developing electro-photographic printer photosensitive body cleaning method as claimed in claim 2, wherein the transfer roller cleaning mechanism comprises:

a backup roller to be pressed against the transfer roller when cleaning the transfer roller;

a sheet material inserted between the backup roller and the transfer roller so as to clean the transfer roller;

a send-out roller for sending out the sheet material;

a roll-up roller for rolling up the sheet material;

a housing for holding the send-out roller, the roll-up roller, and the sheet material;

an actuator connected to the housing for pressing and disconnecting the housing to/from the transfer roller; and a cover for receiving scraped dust as a result of cleaning of the transfer roller.

6. The liquid-developing electro-photographic printer photosensitive body cleaning method as claimed in claim 3, wherein the transfer roller cleaning mechanism comprises:

a backup roller to be pressed against the transfer roller when cleaning the transfer roller;

a sheet material inserted between the backup roller and the transfer roller so as to clean the transfer roller;

a send-out roller for sending out the sheet material;

a roll-up roller for rolling up the sheet material;

a housing for holding the send-out roller, the roll-up roller, and the sheet material;

an actuator connected to the housing for pressing and disconnecting the housing to/from the transfer roller; and a cover for receiving scraped dust as a result of cleaning of the transfer roller.

7. The liquid-developing electro-photographic printer photosensitive body cleaning method as claimed in claim 1, wherein the photosensitive body is a belt-shaped photosensitive body.

8. The liquid-developing electro-photographic printer photosensitive body cleaning method as claimed in claim 2, wherein the photosensitive body is a belt-shaped photosensitive body.

9. The liquid-developing electro-photographic printer photosensitive body cleaning method as claimed in claim 3, wherein the photosensitive body is a belt-shaped photosensitive body.

10. The liquid-developing electro-photographic printer photosensitive body cleaning method as claimed in claim 1, wherein the photosensitive body is a drum-shaped photosensitive body.

11. The liquid-developing electro-photographic printer photosensitive body cleaning method as claimed in claim 2, wherein the photosensitive body is a drum-shaped photosensitive body.

12. The liquid-developing electro-photographic printer photosensitive body cleaning method as claimed in claim 3, wherein the photosensitive body is a drum-shaped photosensitive body.

13. The liquid-developing electro-photographic printer photosensitive body cleaning method as claimed in claim 1, wherein the developed image for cleaning is an entire-area solid pattern of a single color or a plurality of colors to be developed over the entire printing area.

14. The liquid-developing electro-photographic printer photosensitive body cleaning method as claimed in claim 2, wherein the developed image for cleaning is an entire-area solid pattern of a single color or a plurality of colors to be developed over the entire printing area.

* * * * *